US005887516A

United States Patent [19]

Sebright et al.

[11] Patent Number: 5,887,516

[45] Date of Patent: Mar. 30, 1999

[54] APPARATUS FOR EXTRACTING LIQUID FROM A COMPOSITE MASS

[75] Inventors: Brent H. Sebright; Stuart L. Sebright, both of Hopkins, Mich.

[73] Assignee: Sebright Products, Inc., Hopkins, Mich.

[21] Appl. No.: 874,159

[22] Filed: Jun. 13, 1997

[51] Int. Cl.[6] ..... B03B 9/06

[52] U.S. Cl. ..... 100/127; 100/116; 100/192

[58] Field of Search ..... 100/116, 125–129, 100/179, 191, 192

[56] References Cited

U.S. PATENT DOCUMENTS

| | | | |
|---|---|---|---|
| 1,110,283 | 9/1914 | Beaston | 100/127 |
| 1,884,212 | 10/1932 | Power | 100/127 |
| 1,990,839 | 2/1935 | Power | 100/128 |
| 3,550,775 | 12/1970 | Cooley | 100/127 |
| 4,446,788 | 5/1984 | Molnar | 100/129 |
| 4,603,909 | 8/1986 | Le Jeune | 100/127 |
| 4,665,817 | 5/1987 | Simpson | 100/127 |
| 5,215,007 | 6/1993 | Sebright et al. | 100/127 |
| 5,735,197 | 4/1998 | Kleine | 100/127 |

FOREIGN PATENT DOCUMENTS

| | | | |
|---|---|---|---|
| 1234850 | 10/1960 | France | 100/127 |
| 275489 | 6/1930 | Italy | 100/127 |
| 6-92402 | 4/1994 | Japan | 100/126 |
| 54116 | 7/1934 | Norway | 100/129 |
| 315807 | 10/1969 | Sweden | 100/127 |

*Primary Examiner*—Stephen F. Gerrity
*Attorney, Agent, or Firm*—Rader, Fishman, Grauer & McGarry

[57] ABSTRACT

An apparatus for removing liquid from a composite mixture of liquid and solids comprising a hopper 16 mounted atop a compactor ram assembly 10, having a snout section 12 and an extruder section 14 mounted in a generally axial direction to the compactor ram assembly 10. Wet waste material is loaded into the hopper 16 and falls onto a loading floor 158. A hydraulically operated ram 208 compresses the wet material into the snout and extruder sections 12, 14. Under pressure from the ram 208, liquid in the waste material escapes from numerous drainage slots 25 in the loading floor, the snout section top, bottom and sides 24, 22, 20, and the extruder section top, bottom and sides 30, 28, 26. A platen 80, pivotally mounted to the extruder top plate 30 near the exit of the device and biased with a constant pressure, controls the back pressure in the extruder and snout sections 14, 12. A first embodiment has a converging extruder section 14, having a narrower cross section at the exit of the section, which aids in compacting the material being dewatered. A second embodiment has a slightly diverging extruder section to prevent impaction of dewater material inside the device when operating with certain composite mixtures such as paper pulp.

21 Claims, 8 Drawing Sheets

APPARATUS FOR EXTRACTING LIQUID FROM A COMPOSITE MASS

BACKGROUND OF THE INVENTION

1. Field of the Invention

This invention relates to compression-operated liquid extraction devices and, more particularly, to an extraction device having elongated drainage openings.

2. Description of Related Art

Batch process, compression-driven liquid extraction devices have been well known for many years. Existing devices compress wet waste in a compression chamber below a loading hopper. A hydraulic ram provides pressure to the wet waste. Drainage holes or grates in the sides of the compression chamber permit liquid to escape from the wet waste. Typically, the liquid is extracted directly under the loading hopper. A few designs provide a short extension of the compression chamber past the loading hopper to improve the liquid extraction efficiency. A door on the exit of the chamber is sometimes used to increase the back pressure and obtain a higher degree of compression.

The existing designs generally provide inadequate or incomplete moisture extraction for some important purposes. For example, the moisture content of paper pulp waste, after being processed through existing compression-driven extracting devices, typically exceeds 65% which is not acceptable for many landfills or incinerators. In addition, liquid in the remaining mass is largely unevenly distributed; there is more liquid remaining in the top and bottom of the mass than at the sides. With existing devices, liquid from inside the mass of wet waste must take a longer path to reach a drainage exit. To compensate, the grate design of existing devices provides additional area for drainage but allows a higher percentage of solids to escape with the liquid and also clog the grates. In addition, the grate design of existing devices is unsuitable for high-pressure service.

SUMMARY OF THE INVENTION

A novel design of an apparatus for extracting liquid from a composite mass of liquids and solids according to the invention comprises a housing and an extruder connected to the housing. The housing has a cavity which is open at one end of the housing. The extruder is connected to the housing at the open end and has opposed top and bottom walls and opposed side walls. The top, bottom, and side walls thereby define a channel which is in communication with the cavity. The channel extends to an exit opening from the extruder and at least one of the walls has at least one matrix of slots extending therethrough.

A first platen is mounted within the housing for movement from a retracted position adjacent the cavity and through the cavity and along the axis to an extended position near the open end of the housing. An actuator is operably connected to the first platen to cause it to move to and from the extended position.

A second platen is mounted to one of the extruder walls near the exit opening for pivotable movement inwardly of the channel. The second platen is configured to restrict the cross-sectional area of the channel and is biased inwardly toward the channel against a predetermined pressure. Thus, a composite mass introduced into the cavity of the housing is compressible within the cavity and the channel between the first and second platens. The pressure introduced to the mass by action of the first platen moving to an extended position causes liquid within the mass to be forced through the drainage slots. When the pressure in the mass exceeds a predetermined pressure, the mass is caused to move through the exit opening for subsequent disposal.

According to one aspect of the invention, the side walls and/or the top and bottom walls have one or more matrices of slots extending therethrough. Preferably, the matrices of slots cover a substantial portion of each wall.

According to a further aspect of the invention, the slots extend at an angle between about 45° and about 135° with respect to the direction of composite mass movement, and preferably at an angle of about 90° with respect to the direction of composite mass movement.

According to an even further aspect of the invention, the matrices are formed by a multiplicity of rows of slots, each row of slots being offset from an adjacent row of slots. Preferably, each slot is tapered from an outer surface to an inner surface of each wall.

A loading platform can be mounted within the housing in a lower portion of the cavity to support the composite mass and the platform is devoid of drainage slots.

BRIEF DESCRIPTION OF THE DRAWINGS

The invention will now be described with reference to the following drawings wherein.

DETAILED DESCRIPTION OF THE DRAWINGS

Figure 1:
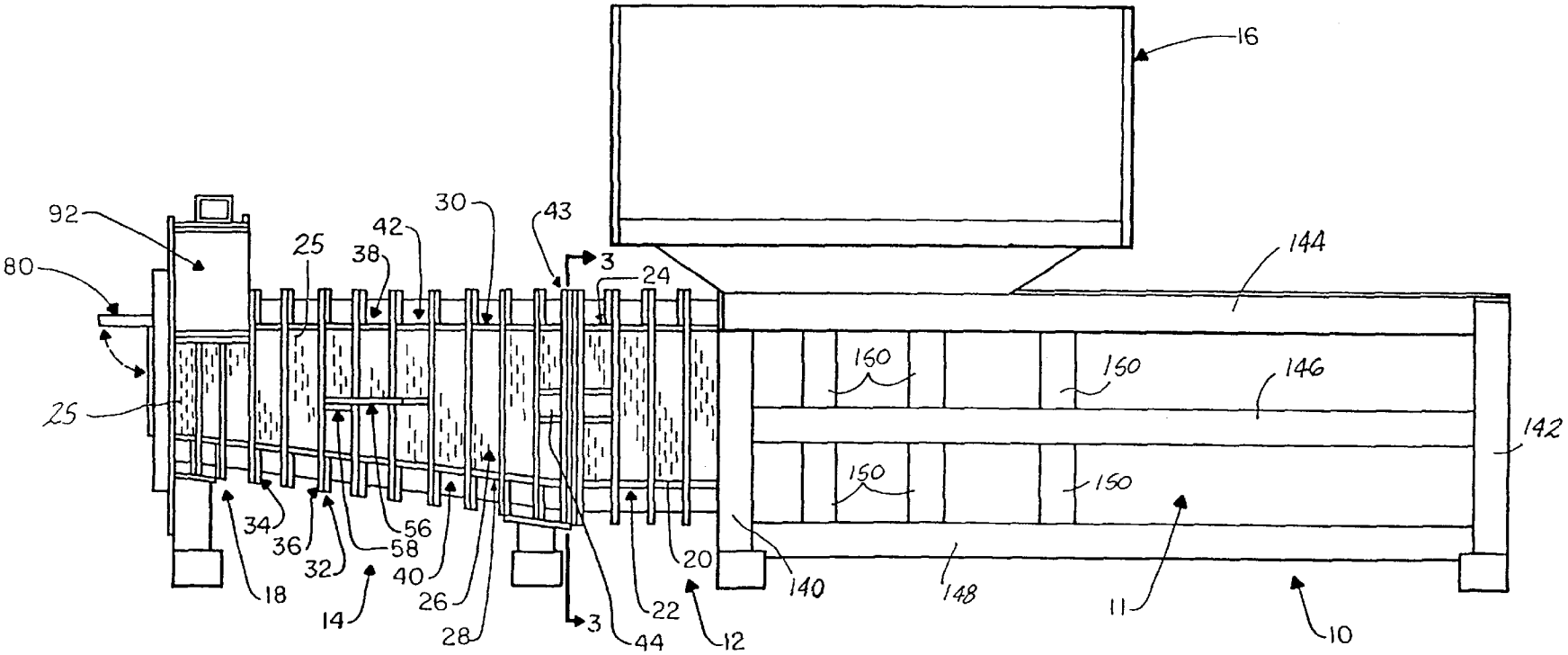
FIG. 1 is a left side elevation of a first embodiment of a waste extruder or dewatering device according to the invention.
Figure 2:
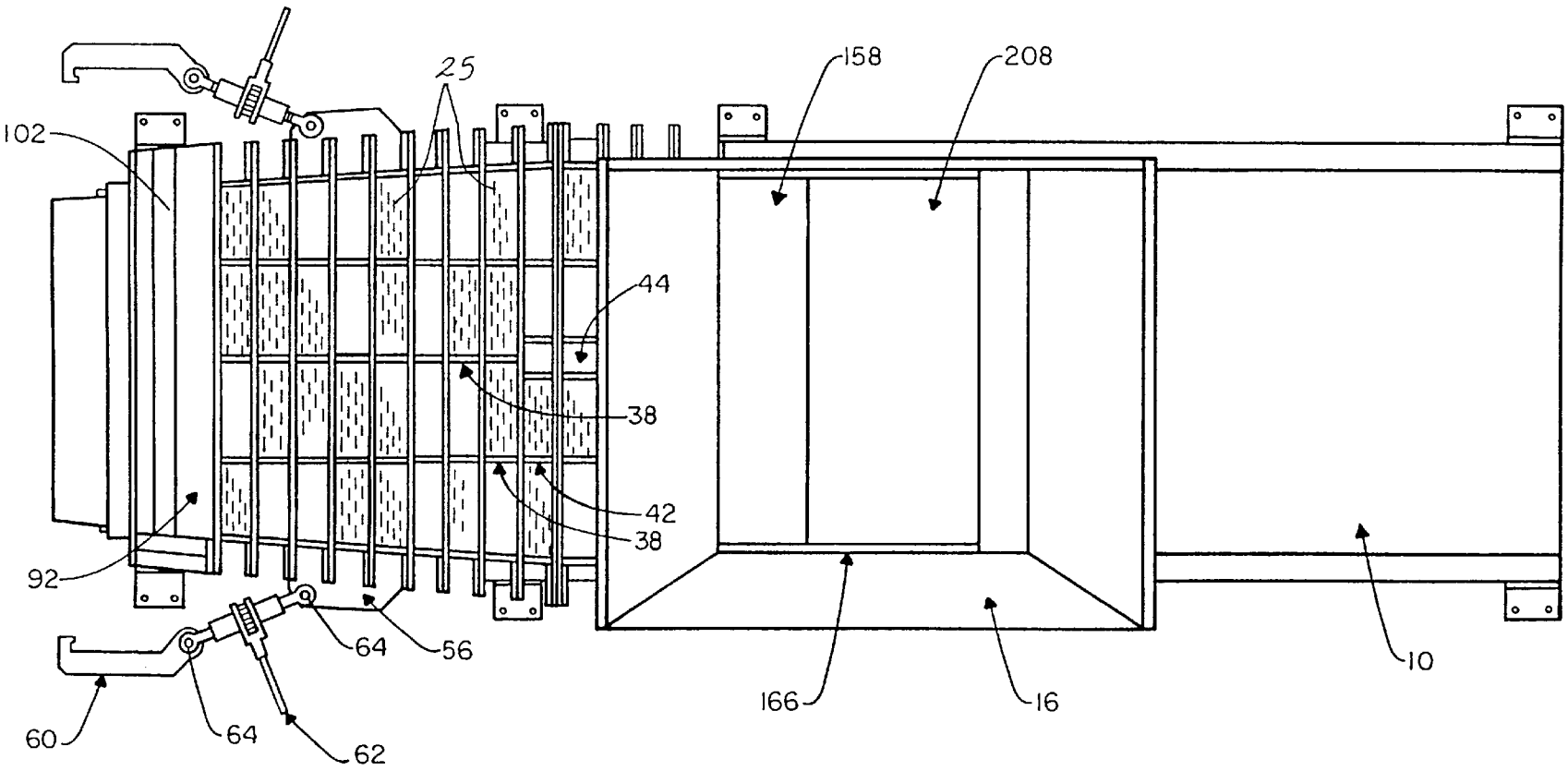
FIG. 2 is a plan view of the dewatering device of FIG. 1.

Referring now to the drawings and to FIGS. 1 and 2 in particular, the device for compressing material to be dewatered generally comprises a hopper 16 mounted atop a horizontal compactor ram assembly 10 for receiving the material, a snout section 12, an extruder section 14, and an extruder plenum assembly 18 mounted in a generally axial direction with respect to the compactor ram assembly 10.

The dewater material is a composite mass of liquid and solids which the device compresses to remove much of the liquid, leaving a drier product more suitable for land fill or recycling. The liquid in the material may include water, oils, greases, solvents and other liquids, and any combination thereof. Typical liquid and solid mixtures which require dewatering include paper pulp, garbage, animal hair and follicle solvent from leather manufacture, animal by-products, dairy products, and other wet waste products. The input dewater material is typically 5%–15% solids, and in the prior art, the output dewater material can be approximately 54% or more solids. This invention is an improvement over U.S. Pat. No. 5,215,007 issued to Sebright et al. on Jun. 1, 1993, the disclosure of which is hereby incorporated by reference. Surprisingly, the output dewater material from a device according to this invention can typically be as much as 90% or higher solids, greatly exceeding the dewatering capacity of existing devices, due to the configuration and arrangement of slots 25 on the device, as will be described in greater detail below.

In operation, the hopper 16 feeds dewater material into a cavity in the device. A platen of a ram 208 operated by one or more hydraulic cylinders or actuators pushes the dewater material into the snout section 12 and then into the extruder section 14. Pressure supplied by the ram 208 drives liquid out of the dewater material through matrices of drainage slots 25 in the top and bottom of the snout and extruder sections 12, 14. Another platen 80, rotatably mounted near the exit of the extruder section 14 and biased with a constant pressure, restricts the passage of the dewater material out of the extruder and controls pressure inside the extruder.

The snout section 12 is a generally rectangular shaped horizontal duct comprised of two parallel rectangular snout side plates 20, a rectangular snout bottom plate 22, normal to the face of the snout side plates 20, and a parallel rectangular snout top plate 24, all of which are penetrated by a matrix of small drainage slots 25 which permit the liquid to escape during the dewatering process. The extruder section 14 is similarly constructed, having extruder side plates 26, an extruder bottom plate 28 and an extruder top plate 30 all of which are also penetrated by drainage slots 25.

The extruder section 14 has a converging shape, with a smaller opening at its exit than at its entrance. The extruder top plate 30 is oriented horizontally, but the extruder bottom plate 28 is oriented with an upward tilt, as shown in FIG. 1, with the edge connecting to the extruder plenum 18 higher than the edge connected to the snout section 12. The extruder side plates 26 are also oriented to provide a converging flow for the dewater material through the device, as shown in FIG. 2, with the edges of the extruder side plates 26 connected to the snout section 12 farther apart than the edges of the extruder side plates 26 connected to the extruder plenum 18. The converging design of the extruder section 14 helps to compact the dewater material as liquid is removed by the device. The angle of the extruder bottom plate 28 allows extracted liquid to flow by gravity away from the extruder plenum 18. Additionally, the angle of the extruder bottom plate 28 causes the compressed dewater material to exit the device at an upward angle and gravity causes the flow to buckle and more efficiently fill a waste container (not shown).

Both the snout section 12 and the extruder section 14 have a series of girdle ribs 32 encircling the circumference of the sections. Each girdle rib 32 comprises two long rectangular vertical brace pieces 36 mounted edgewise on opposite extruder side plates 26, and two rectangular horizontal brace pieces 34 mounted edgewise to the extruder top plate 30 and the extruder bottom plate 28 respectively. The ends of the horizontal and vertical brace pieces 34, 36 extend beyond the sides of the snout and extruder sections 12, 14 and are fastened together in a lap joint to complete the girdle ribs 32. Additional bracing in the snout and extruder sections is provided by three top lateral ribs 38 mounted edgewise and axially to the extruder top plate 30 and snout top plate 24, and three bottom lateral ribs 40 mounted edgewise and axially to the extruder bottom plate 28 and snout bottom plate 22. The top and bottom lateral ribs 38, 40 are formed from brace plates 42 inserted between the faces of the girdle ribs 32.

The extruder section 14 is provided with two container grab hooks 60 mounted at each side by means of a ratchet turnbuckle 62 and a grab hook mounting bracket 56 and grab hook mounting bracket brace 58 which are attached to the side of the snout section 12. Each ratchet turnbuckle 62 is rotatably mounted about a vertical axis by means of a rotating fastener 64 at one end to a grab hook mounting bracket 56 and grab hook mounting bracket brace 58, and at the opposite end to a container grab hook 60. The container grab hooks 60 are adapted to receive and hold in place a waste container to receive the dewater material at the end of the process.

Figure 12:
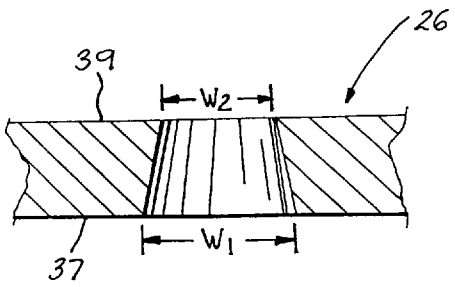
FIG. 12 is a cross section of one of the drainage slots taken along line 12—12 of FIG. 11.
Figure 11:
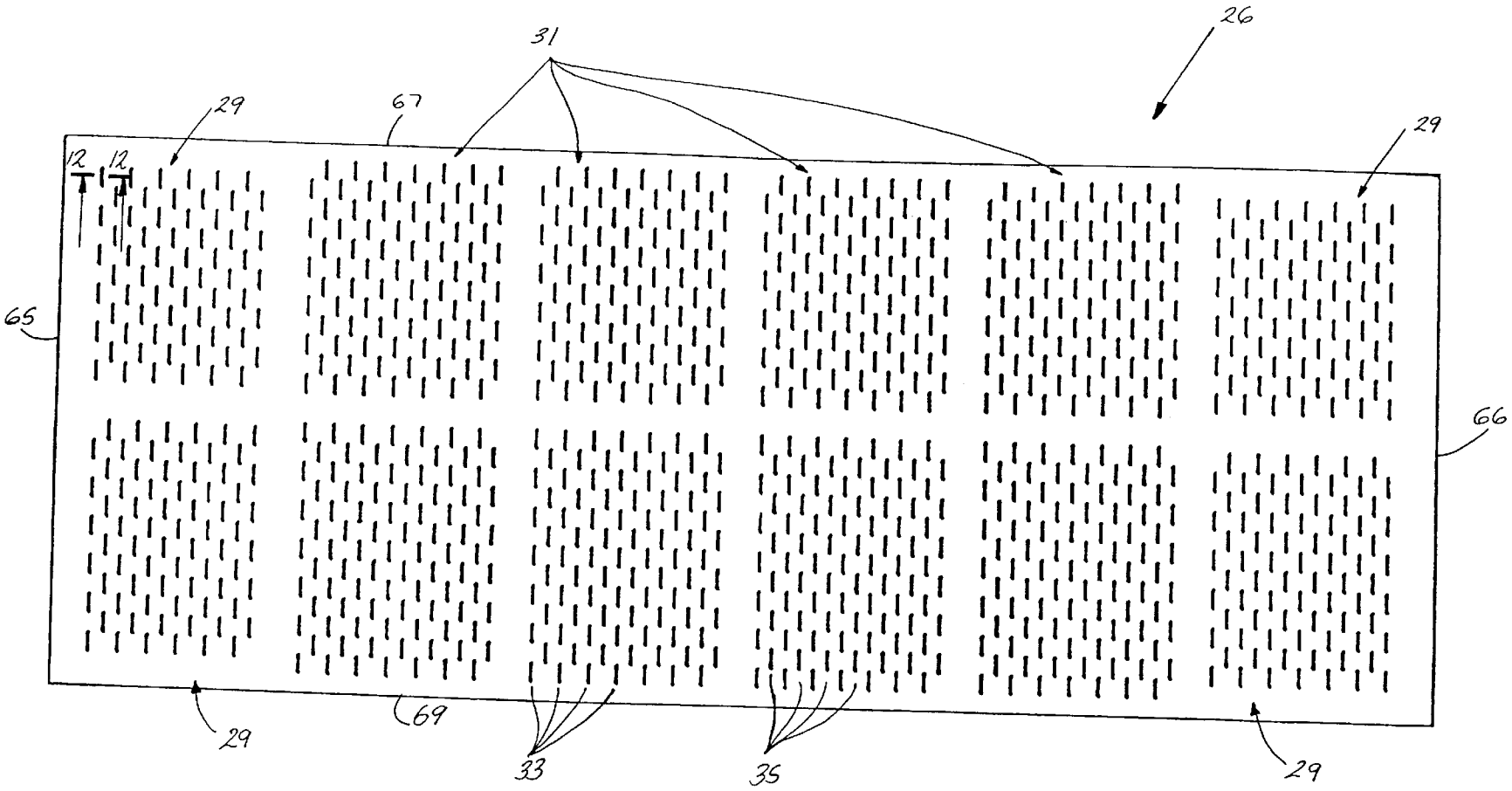
FIG. 11 is a detail view of the extruder side plates for the first embodiment showing the drainage slot arrangement.

With reference now to FIGS. 11 and 12, the drainage slots 25 in the extruder side plates 26 are arranged in end groups or matrices 29 at opposite end edges 65, 66 of the side plates and intermediate groups or matrices 31 between the end groups 20. The slots in each of the groups 29, 31 are linearly aligned in a first set of rows 33 and a second set of rows 35 that are offset from the first set of rows. The rows 33, 35 and slots 25 extend parallel to the girdle ribs 32. By way of example, the drainage slots 25 can be about ½ inch in length, with a width $W_1$ that tapers from about 1/16 inch at the outer surface 37 to a width $W_2$ of about 1/32 inch at the inner surface 39 of the side plate 26 with a thickness typically of about ⅜" to ½". Within each row, the slots are spaced approximately one inch on center, while the rows 33, 35 are spaced from each other about ½ inch on center.

Each end group 29 is spaced approximately 13/16 inch from the left and right edges 65, 66, and the top and bottom edges 67, 69 of each side plate 26. Each intermediate group 31 is spaced about 7/16 inch from the top and bottom edges 67, 69 of each side plate 26. The groups 29, 31 are spaced from each other approximately six inches on center in the longitudinal direction of the plates 26.

While certain dimensions have been given by way of example, it is to be understood that these dimensions may vary widely depending on the type of dewater material and particular construction of the material compressing device. Moreover, although the side plate 26 is shown as substantially rectangular, other shapes are contemplated. It must be kept in mind however, that smaller drainage slots decrease the area for liquid to exit the machine and thus the extraction efficiency, while larger drainage slots increase the amount of solids in the dewater mixture escaping through the drainage slots.

The slots 25 are preferably formed on the plate by an abrasive water jet process to prevent burrs or kerfs around the edges of the slots that would normally be present during stamping, drilling or laser cutting. It is important that the slots are free of excess material left by the manufacturing process, in order to minimize the amount of force required to compress the dewater material. The slots 25 are formed in the side plates 26 so as to extend at an angle within the range of about 45° to 135° with respect to the direction of composite mass movement. Preferably, the slots 25 extend at an angle of about 90° with respect to the direction of composite mass movement. However, due to the varying wall configurations of the different sections of the device, it may be impractical to continuously orient the slots at the 90° angle.

A similar arrangement of drainage slots 25 is provided on the extruder top and bottom plates 30, 28, and the snout section 12. Again, the slots extend at an angle within the range of about 45° to 135° with respect to the direction of composite mass movement, and preferably substantially parallel to the ribs 32 and/or substantially perpendicular to the direction of travel of the dewater material during compression.

Figure 4:
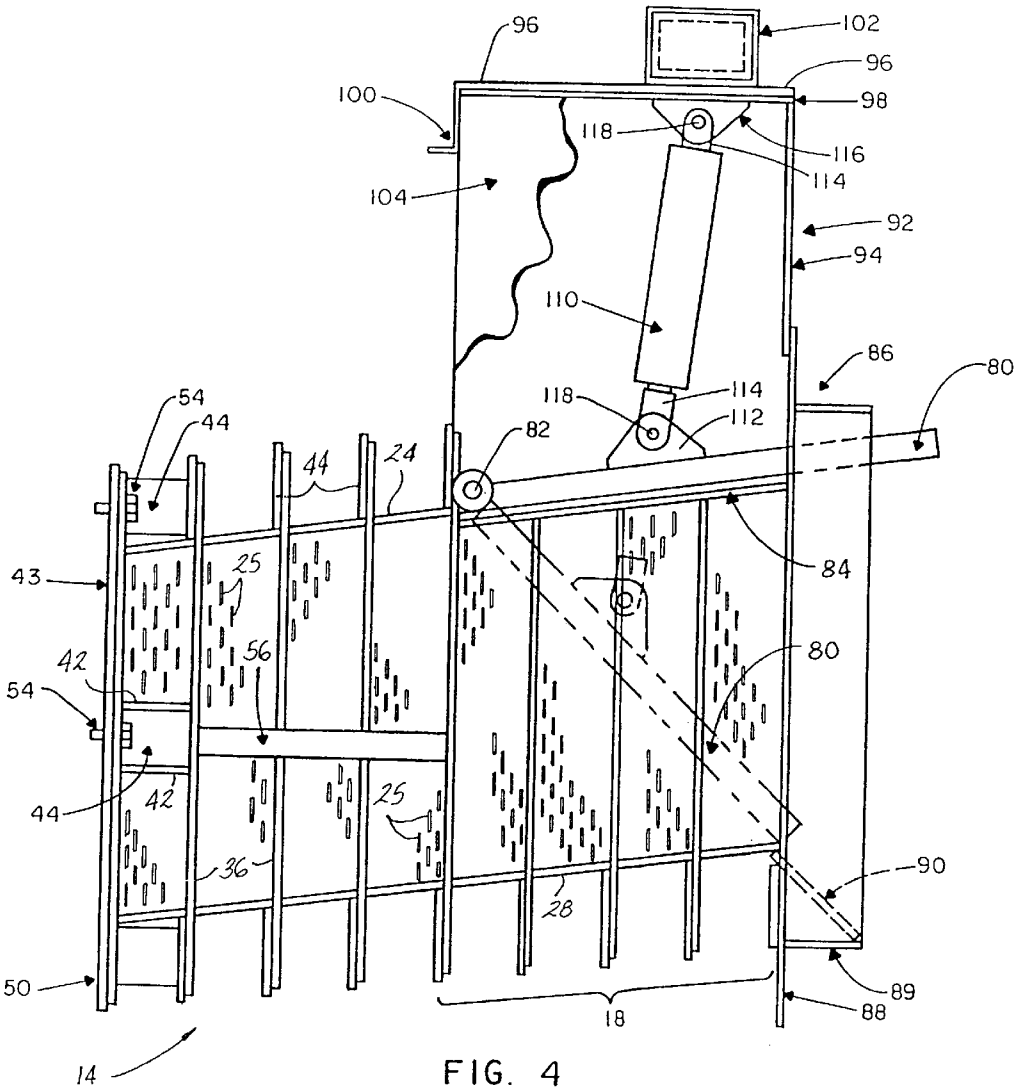
FIG. 4 is a partial side elevation of the dewatering device of FIG. 1 showing the plenum section of the second embodiment.
Figure 3:
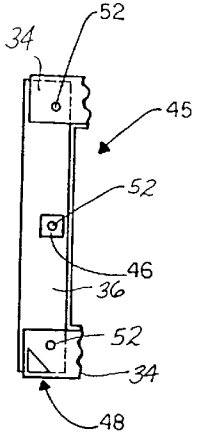
FIG. 3 is a view in cross section taken along the line 3—3 of FIG. 1 showing the extruder section mounting in detail.

Referring now to FIGS. 3 and 4, the extruder section 14 is mounted to the snout section 12 by means of fasteners 54 penetrating fastener holes located in an extruder section mounting plate 43 mounted at the end of the extruder section 14, and mating fastener holes 52 located in a snout section mounting plate 45 mounted at the end of the snout section 12. The extruder and snout section mounting plates 43, 45 are comprised of girdle ribs 32. Both the extruder section mounting plate 43 and the snout section mounting plate 45 have fastener holes 52 penetrating their faces at each corner and in the center of the horizontal brace plates 34 and the vertical brace plates 36 forming the girdle rib 32. Plate spacers 46, of the same thickness as the horizontal brace plates 34, are mounted on each vertical brace plate 36 of the extruder section mounting plate 43 and the snout section mounting plate 45, and are also penetrated by fastener holes 52. The snout section mounting plate 45 has a triangleshaped gusset 48 mounted in each of its lower comers. The extruder section mounting plate 43 has gusset notches 50 in the lower comers shaped to receive the gusset plates 48. A fastener channel 44 is formed about each of the fasteners in the middle of the horizontal braces 34 and vertical braces 36 by means of brace plates 42 mounted adjacent to the fastener hole 52 and perpendicular to the extruder section mounting. The exit flange 86 is attached to the ends of the outer face of the extruder side plates 26. The hole in the exit flange 86 extends above and below the exit of the extruder plenum section 18. An exit flange ramp 90 extends along the lower edge of the extruder plenum section 18 exit and angles down to the outside edge of the exit flange lip 89.

Figure 5:
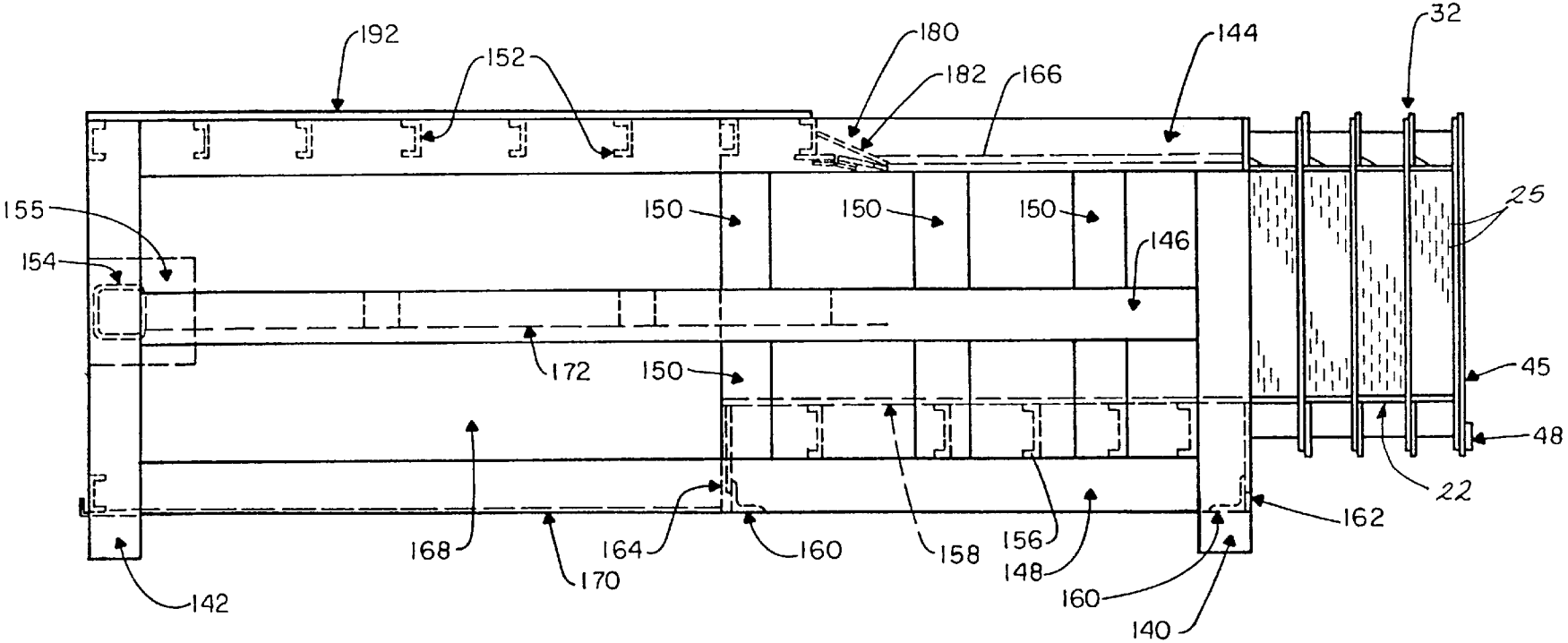
FIG. 5 is a partial side elevation of the dewatering device of FIG. 1 showing the compactor section.
Figure 6:
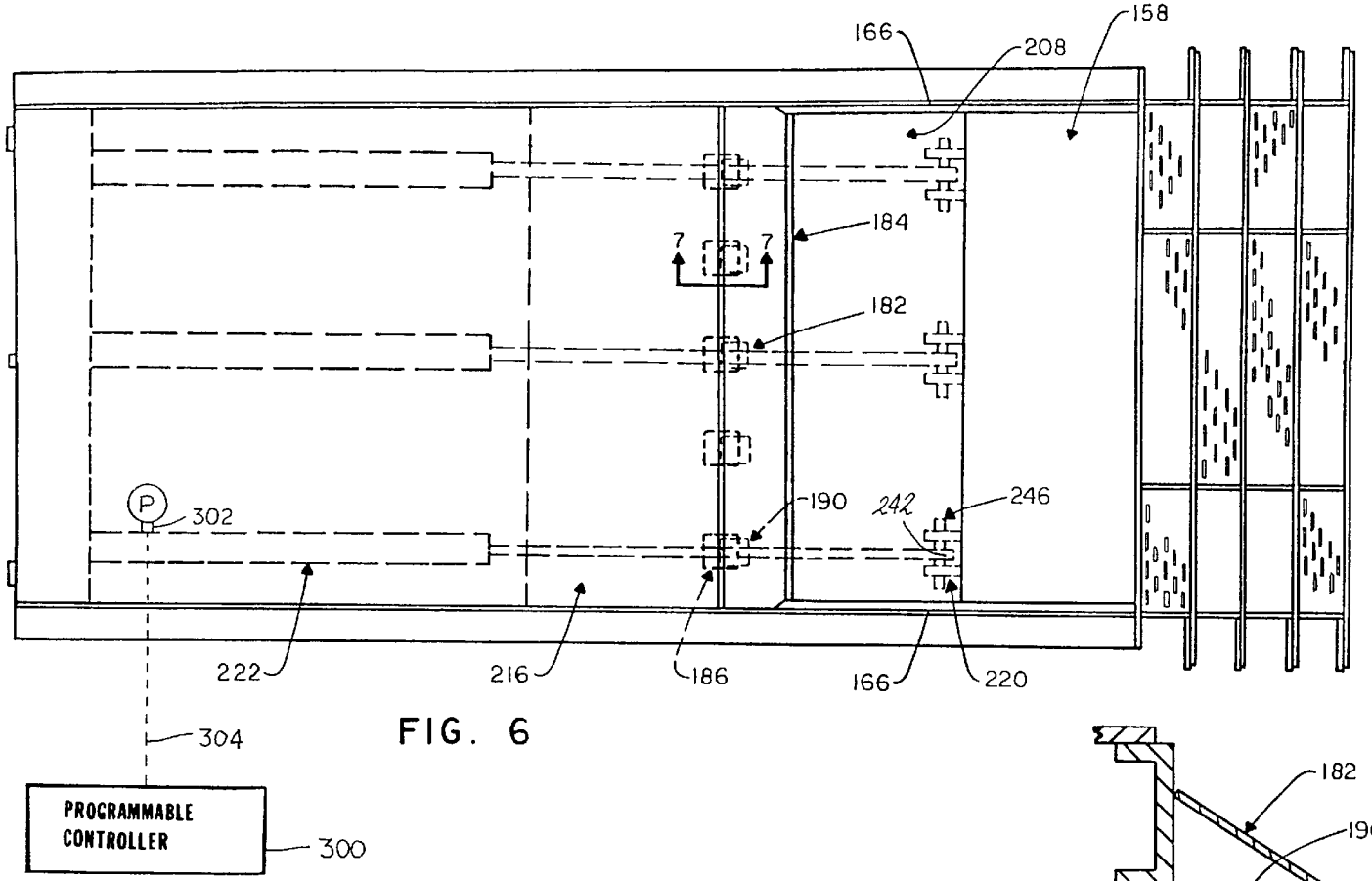
FIG. 6 is a top plan view of the compactor section of FIG. 5.

Referring now to FIGS. 1, 5 and 6, the compactor ram assembly 10 comprises a housing 11 framed by two vertical front comer posts 140 and two vertical rear comer posts 142 connected on each side by a top horizontal side member 144 attached perpendicular to and atop the front comer post 140 and perpendicular to and abutting the rear comer post 142, a middle horizontal side member 146 attached slightly above the midline of the front comer post 140 and rear comer post 142, and a bottom horizontal side member 148 attached between and slightly above the bottom of the front comer post 140 and rear comer post 142. Additional bracing is provided by three vertical side members 150 attached between the top horizontal side member 144 and the middle horizontal side member 146 on each side. Two of the vertical side members 150 are provided beneath the hopper 16 and an additional vertical side member 150 is immediately behind the hopper 16. Three additional vertical side members 150 are placed between the middle horizontal side member and the bottom horizontal side member on each side immediately below the aforementioned vertical side members 150. The compactor ram assembly 10 is enclosed by two side panels 168 attached just inside of the front and rear comer post 140, 142, a top panel 192 attached to the top horizontal side members 144 and extending back from the hopper 16 to the rear corner post 142 and a rear floor plate 170 extending along the bottom of the bottom horizontal side member to the first vertical side member 150. The housing 11 thus defines a cavity in the interior thereof which is open at one end for communication with the snout section 12. The cavity is also open at the top for receiving dewater material from the hopper 16. A loading floor 158 is provided within the cavity below the hopper 16 for receiving the wet matter to be dewatered. The loading floor 158 is supported by a series of lower cross members 156 mounted horizontally and transversely to the direction of ram travel. The lower cross members 156 are mounted between the side panels 168 and immediately above the bottom horizontal side members 148. Additionally, the loading floor 158 is supported by a front plate 162 and rear plate 164 mounted vertically at the front end rear edge of the loading floor 158 and installed between the side panels 168. The bottom of the front and rear plates 162, 164 are supported by angle brackets 160 mounted between the side panels 168. The loading floor 158 is connected to, and is at the same elevation as the extruder bottom plate 22. Although the loading floor is shown devoid of slots, it is within the scope of the invention for the slots 25 to be formed in the loading platform.

A series of upper cross members 152 also support the housing 11 laterally. The upper cross members 152 are mounted horizontally and attached at each end to the side panels 168 immediately below the top panel 192. Both the upper and lower cross members 152, 156 are C-shaped in cross section.

Figure 8:
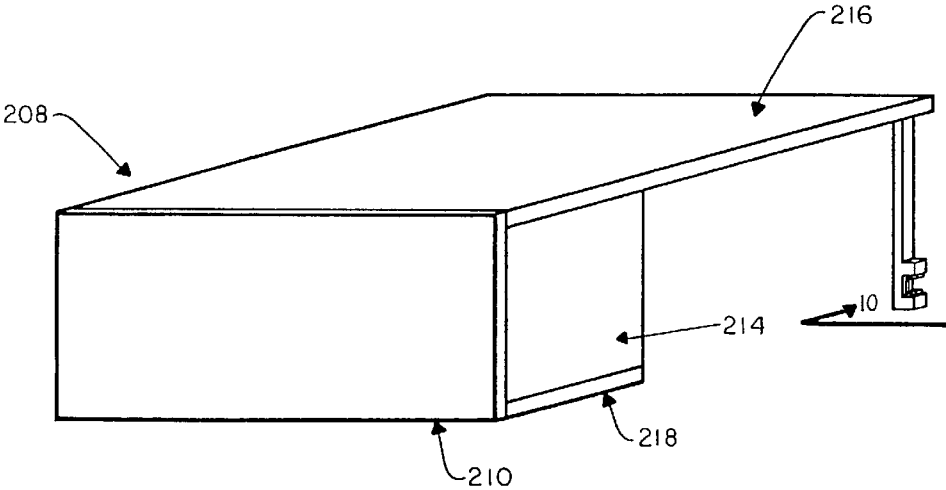
FIG. 8 is a front perspective view of the ram.
Figure 9:
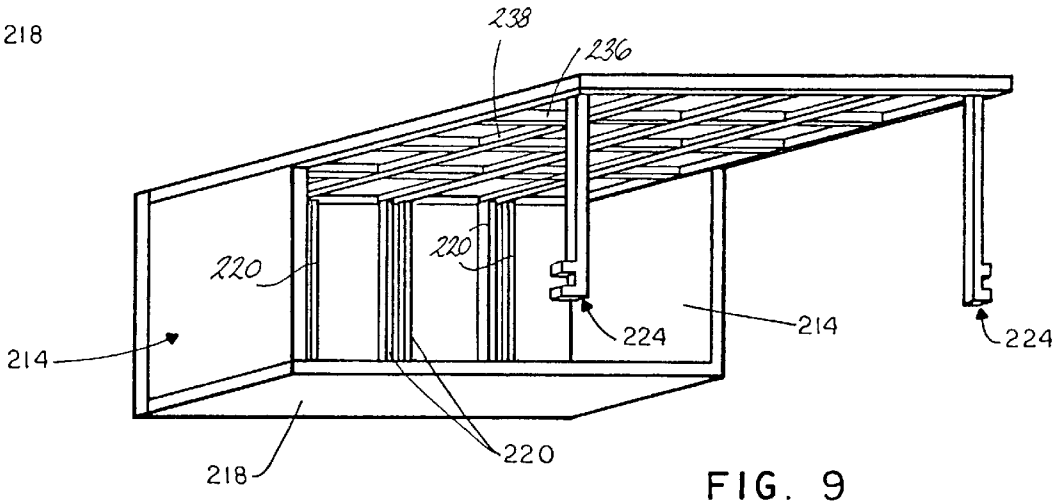
FIG. 9 is a rear perspective view of the ram.

Referring as well to FIGS. 8 and 9, the ram 208 comprises a ram face 210, which, unlike the prior art, is devoid of openings to prevent compaction of material that would otherwise occur in the holes during the dewatering process, as well as providing better control over the direction of liquid flow. Although the ram face is shown devoid of slots, it is within the scope of the invention to provide slots 25 on the ram face if desired. The ram face is braced by the ram side plates 214, the ram bottom plates 218, and the ram top plates 216. The ram side plates 214 extend rearwardly from the rear of the ram face 210 and are attached edgewise at the outside edge of the rear of the ram face 210. The ram bottom plate 218 is attached in a similar manner on the bottom rear edge of the ram face 210. The ram bottom plate 218 is thus adapted to move reciprocally with the ram on the loading floor 158. The ram top plate 216 is attached similarly to the top rear edge of the ram face 210 and extends much further back than the rain side plates 214 and the ram bottom plates 218, so that it may protect the ram cylinders 222 during operation, and to prevent dewater material from falling behind the ram face 210.

The ram top 216 is braced by 5 or 6 longitudinal braces 238 comprising six inch channel beams welded along the bottom surface of the ram top 216 extending from the front to the rear of the ram top 216. Additional bracing of the ram top 216 is provided by lateral braces 236 of six inch channel beam stock welded to the bottom surface of the ram top 216 perpendicular to the longitudinal braces 238 and placed in between the longitudinal braces 238 in a grid formation, with more emphasis on the front portion of the ram to-D 216, near the ram face 210.

The ram face 210 is preferably driven by two or more ram cylinders 222, as illustrated by three ram cylinders 222, mounted at one end to the rear of the ram face 210 and at the other end to the rear cross member 154. The ram cylinders are mounted to the ram face 210 by means of three pairs of splines 220 mounted edgewise to the rear of the ram face 210 and extending from the top to the bottom of the ram face 210. The splines 220 are also attached at their ends to the ram top 216 and the ram bottom 218. The splines provide bracing and are spaced so that a tab 242 on the end of each ram cylinder 222 will fit in between a pair of splines 220.

Holes (not shown) penetrating the face of each spline 220 at the midsection mate with a hole (not shown) in each tab 242 receiving a pin 246 to affix the ram cylinder 222 to the ram face 210.

The rear cross member 154 comprises a hollow beam having a rectangular cross section, horizontally mounted at each end to the inside rear face of the side panels 168 so as to extend perpendicularly therefrom, and parallel and flush to the rear wall of the ram compactor assembly 10. The rear cross member 154 bears the load of the ram cylinders 222 and rear cross member mounting plates 155 are provided at the mounting points of the rear cross member 154 for increased strength. The ram cylinders 222 are bolted to the rear cross member 154.

A pair of access doors 157 is provided at the rear wall of the ram compactor assembly 10.

Figure 10:
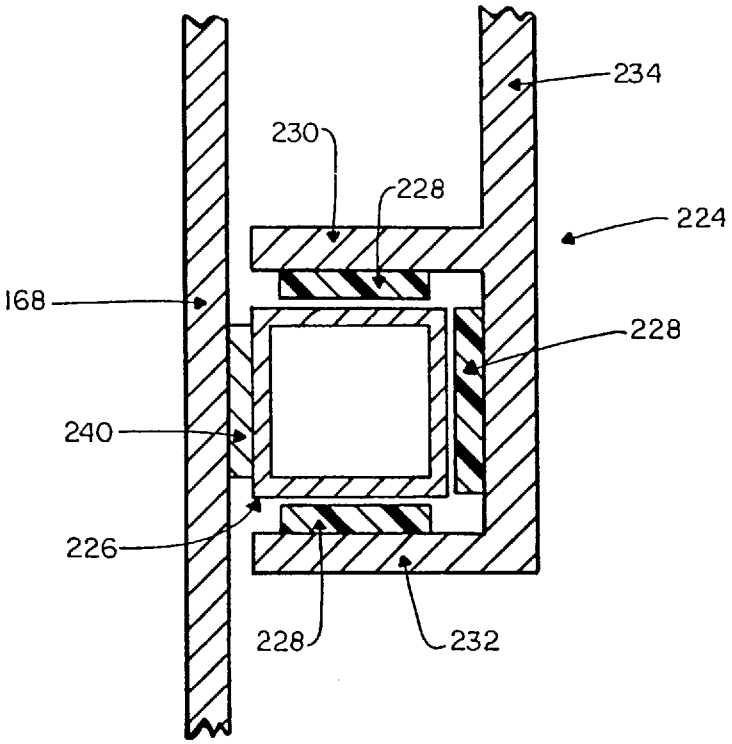
FIG. 10 is a cross section taken along line 10—10 of FIG. 9, showing the ram guide.

Referring now to FIGS. 8–10, direction of ram travel is controlled by a pair of ram guides 226. Each ram guide 226 comprises a hollow beam of rectangular cross section mounted horizontally at about the midsection of, and along the inside wall of one of the side plates 168 by means of several ram guide spacers 240 mounted along the ram guide 226 which are in turn mounted to the side plate 168, thus holding the ram guide 226 slightly away from the side plate 168. A C-shaped ram guide bracket 224 shaped to receive the ram guide 226 travels along each ram guide 226 in operation and keeps the ram 208 oriented properly.

A pair of vertical arms 234 extends vertically down from the rear corners of the ram top 216, being mounted to both the inside of the outermost longitudinal brace 236, the inside of the most rear lateral brace 236 and to the underside of the ram top 216. At the bottom of each vertical arm 234 a lower arm 232 and an upper arm 230 extend horizontally towards the side panel 168 forming the structure of the ram guide bracket 224. The surfaces of the lower arm 232, the upper arm 230 and the vertical arm 234 oriented toward the ram guide 226, are provided with NYLATRON™ (or a suitable substitute) ram guide inserts 228, mounted by means of countersunk screws, which contact the ram guide 226 during operation. The ram guide inserts 228 reduce friction and are easily replaceable when worn.

The ram guide 226 orients and guides the ram 208 from the rear due to the placement of the vertical arms 234. The ram face is guided by the loading floor 158 on the bottom, the side panels 168 on the sides, and a pair of side beads 166 (FIG. 5) along the top. The side beads are mounted to the side panels 168 extending horizontally along the upper edge of the ram face 210 travel to prevent the ram 208 from becoming misaligned in the upwards direction.

Figure 7:
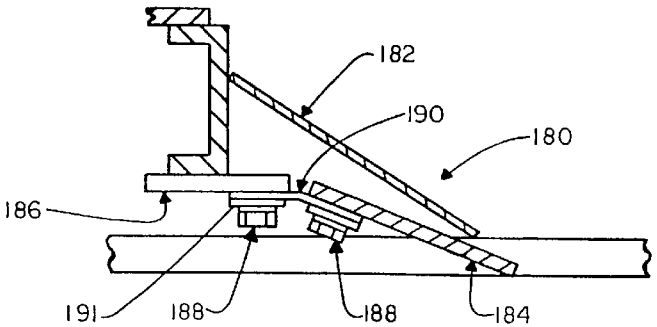
FIG. 7 is a cross-sectional view taken along the line 7—7 of FIG. 6 showing the scraper assembly in detail.

Referring now to FIG. 7, the top surface of the ram top plate 216 is cleaned by a scraper assembly 180 which scrapes the excess pulp to be dewatered off the ram 208 and onto the loading floor 158 as the ram is retracted. The scraper assembly 180 comprises a scraper plate 184 attached to the bottom of the foremost upper cross member 152 by means of a series of fabric scraper hinges 190 and mounting plates 186. Each mounting plate 186 is mounted in a horizontal orientation to the bottom of the foremost upper cross member 152. The fabric scraper hinges 190 are mounted to the underside of the mounting plates 186 and scraper plate 184 by means of a scraper hinge screw 188 and scraper hinge washer 191. The scraper assembly 180 extends transversely across the entire width of the hopper opening 16, and the front edge of the scraper plate 184 contacts the top surface of the ram top plate 216. The angle plate 182 is mounted immediately above the scraper plate 184, extending transversely across the entire width of the ram top plate 216. The upper rear edge of the angle plate 182 is mounted to the forward face of the foremost upper cross member 152; the angle plate 182 angles down until the front edge is slightly above the top surface of the scraper plate 184. The orientation of the fixedly mounted angle plate 182 provides a limited amount of movement for the scraper plate 184 about the scraper hinges 190.

Operation of the dewatering process is described in detail in U.S. Pat. No. 5,215,007 referenced above, and will therefore not be further described.

Although the above description relates to a converging extruder section 14 in conjunction with the slots 25, it is to be understood that the slots 25 can also replace the openings in a diverging extruder section, as described in U.S. Pat. No. 5,215,007 and shown in FIGS. 14 and 15 of that patent. The drainage slots 25 in the diverging extruder would be arranged in the same fashion as the drainage slots 25 in the converging extruder 14.

While particular embodiments of the invention have been shown, it will be understood, of course, that the invention is not limited thereto since modifications may be made by those skilled in the art, particular in light of the foregoing teachings. Reasonable variation and modification are possible within the foregoing disclosure of the invention without departing from the scope of the invention.

The embodiments of the invention in which an exclusive property or privilege is claimed are defined as follows:

1. In an apparatus for extracting liquid from a composite mass of liquid and solids, said apparatus comprising:

a housing having a cavity open at one end;

a first platen mounted within the housing for movement from a retracted position adjacent to the cavity, through the cavity and to an extended position near the open end;

an actuator operably connected to the first platen to cause movement thereof;

an extruder connected to the housing at the open end and having opposed top and bottom walls and opposed side walls, said top, bottom and side walls defining a channel in communication with the cavity extending to an exit opening;

a second platen mounted to one of said extruder walls near the exit opening for pivotable movement inwardly of the channel, said second platen being configured to restrict the cross-sectional area of the channel; and at least one biasing member connected to the second platen for maintaining the second platen inwardly of the channel against a predetermined pressure;

the improvement comprising:

at least one of said walls having at least one matrix of drainage slots extending therethrough and each slot having a cross section that continuously diverges from an inner surface to an outer surface of said at least one wall;

wherein the composite mass is compressible within the cavity and the channel and between the first and second platens such that liquid is extracted therefrom and forced through the drainage slots and the remaining mass is moved through the exit opening when the pressure of the composite mass exceeds the predetermined pressure.

2. An apparatus according to claim 1 wherein the slots extend at an angle in the range of about 45° to 135° with respect to the direction of composite mass movement.

3. An apparatus according to claim 2 wherein the slots extend at an angle of about 90° with respect to the direction of composite mass movement.

4. An apparatus according to claim 1 and further comprising a plurality of matrices of drainage slots arranged along each of the side walls.

5. An apparatus according to claim 4 wherein the matrices cover a substantial portion of each side wall.

6. An apparatus according to claim 1 wherein the at least one matrix of slots comprises at least one matrix of slots extending through each of the top and bottom walls.

7. An apparatus according to claim 6 wherein the slots of said top and bottom walls extend at an angle in the range of about 45° to 135° with respect to the direction of composite mass movement.

8. An apparatus according to claim 7 wherein the slots of said top and bottom walls extend at an angle of about 90° with respect to the direction of composite mass movement.

9. An apparatus according to claim 6 and further comprising a plurality of matrices of drainage slots arranged along each of the top and bottom walls.

10. An apparatus according to claim 9 wherein the matrices cover a substantial portion of each top and bottom wall.

11. An apparatus according to claim 1 and further comprising a loading platform mounted within the housing at a lower portion of the cavity to support the composite mass, and wherein the loading platform is devoid of drainage openings.

12. An apparatus according to claim 1 wherein the at least one matrix is formed by a multiplicity of rows of slots, each row of slots being offset from an adjacent row of slots.

13. An apparatus according to claim 1 wherein each slot is formed with an abrasive water jet.

14. In an apparatus for extracting liquid from a composite mass of liquid and solids, said apparatus comprising:

a housing having a cavity open at one end with an axis extending therethrough;

a platen mounted within the housing for movement from a retracted position adjacent to the cavity, through the cavity and along the axis to an extended position near the open end;

an actuator operably connected to the platen to cause movement thereof;

an extruder connected to the housing at the open end and having opposed top and bottom walls and opposed side walls, said top, bottom and side walls defining a channel in communication with the cavity extending to an exit opening, said bottom wall being inclined upwardly at an angle from the axis, at least one of the extruder walls converging toward its opposing wall so that the cross-sectional area of the channel near the housing is greater than the cross-sectional area of the channel away from the housing, the improvement comprising:

each of said walls having at least one matrix of slots extending therethrough and each slot having a cross section that continuously diverges from an inner surface to an outer surface of said at least one wall;

the composite mass being compressible within the cavity and the channel and between the platen and the converging walls of the extruder to thereby extract liquid therefrom and force it through the slots and to move the remaining mass through the exit opening.

15. An apparatus according to claim 14 wherein the slots in each wall extend at an angle in the range of about 45° to 135° with respect to the axis.

16. An apparatus according to claim 15 wherein the slots in each wall extend at an angle of about 90° with respect to the axis.

17. An apparatus according to claim 14 and further comprising a plurality of matrices of drainage slots arranged along each of the walls.

18. An apparatus according to claim 17 wherein the matrices cover a substantial portion of each wall.

19. An apparatus according to claim 14 and further comprising a loading platform mounted within the housing at a lower portion of the cavity to support the composite mass, and wherein the loading platform is devoid of drainage openings.

20. An apparatus according to claim 14 wherein each matrix is formed by a multiplicity of rows of slots, each row of slots being offset from an adjacent row of slots.

21. An apparatus according to claim 14 wherein each slot is tapered from an outer surface to an inner surface of each wall.

* * * * *